73-151 SR
12/31/85 OR 4,561,299

United States Patent [19]
Orlando et al.

[11] Patent Number: 4,561,299
[45] Date of Patent: Dec. 31, 1985

[54] APPARATUS FOR DETECTING CHANGES IN INCLINATION OR ACCELERATION

[75] Inventors: Franklin P. Orlando, Morgan Hill; Joseph S. Goulart, Santa Clara; Rangasami S. Chandra, Walnut Creek, all of Calif.

[73] Assignee: FMC Corporation, Chicago, Ill.

[21] Appl. No.: 579,624

[22] Filed: Feb. 13, 1984

[51] Int. Cl.[4] ..... G01C 9/06
[52] U.S. Cl. ..... 73/151; 33/366; 73/517 R
[58] Field of Search ..... 73/151, 517 R; 33/366, 33/391, 365, 392

[56] References Cited

U.S. PATENT DOCUMENTS

| | | | |
|---|---|---|---|
| 2,552,722 | 5/1951 | King | 73/516 R |
| 2,695,211 | 11/1954 | Guttwein et al. | 73/516 R X |
| 3,083,469 | 4/1963 | Herbst | 33/366 |
| 3,464,276 | 9/1969 | Leibert | 33/366 X |
| 3,817,094 | 6/1974 | Montgomery et al. | 73/151 |
| 4,143,546 | 3/1979 | Wiener | 73/151 |
| 4,498,341 | 2/1985 | Breitbach et al. | 73/517 R |

FOREIGN PATENT DOCUMENTS

| | | | |
|---|---|---|---|
| 6636 | 7/1981 | European Pat. Off. | 73/517 R |
| 2709156 | 7/1978 | Fed. Rep. of Germany | 73/517 R |
| 45431 | 1/1962 | Poland | 73/517 R |

OTHER PUBLICATIONS

Tensometric Accelerometers with Overload Protection by Moskalik from Izmeritel'naya Tekhnika, No. 12, pp. 43–44, 12–1979.

"Hall Effect Transducers" Published by Micro Switch, a Honeywell Div. Freeport IL 61032.

The Magnetoresistive Sensor by U. Dibbern & A. Petersen.

Electrohydraulic Controls–Brochure of Sundstrand Mobile Controls.

*Primary Examiner*—Stewart J. Levy
*Assistant Examiner*—John E. Chapman, Jr.
*Attorney, Agent, or Firm*—A. J. Moore; H. M. Stanley; R. B. Megley

[57] ABSTRACT

Apparatus for detecting changes in inclination or acceleration is disclosed. In its preferred environment the apparatus is used to determine the position of the sucker-rod of a sucker-rod pump. The preferred embodiment of the apparatus includes a magnetic-field sensor such as a linear output transducer which provides a linear output signal, and a cantilever spring having a counterweight and magnet on its free end disposed adjacent the linear transducer. Oscillation of the walking beam of the pump causes the spring supported magnet to move relative to the sensor producing linear output signals which are processed by other means to determine the position of the sucker-rod at all times. The apparatus may be used in other environments to determine either changes in inclination or changes in acceleration.

1 Claim, 16 Drawing Figures

FIG_10
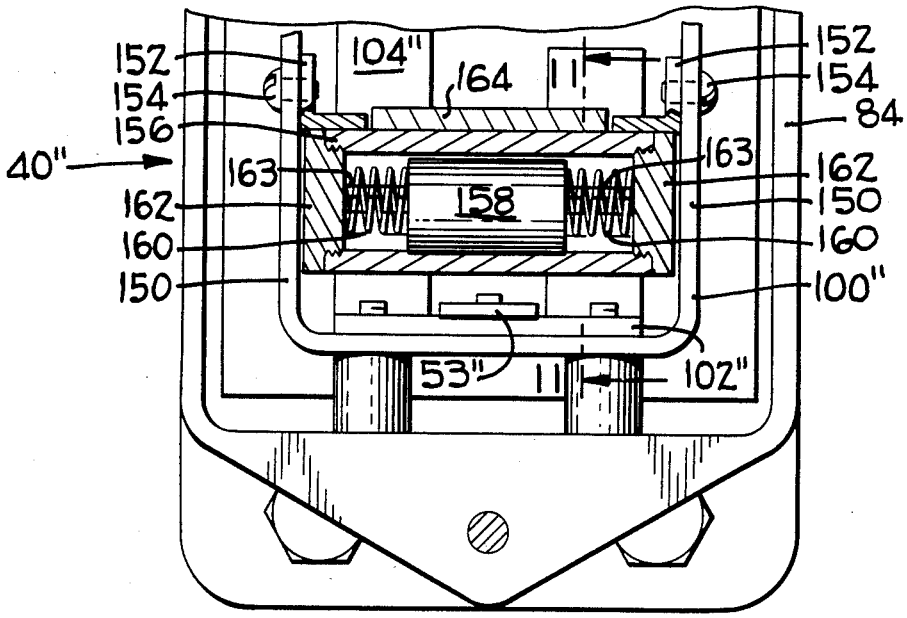
FIG_11
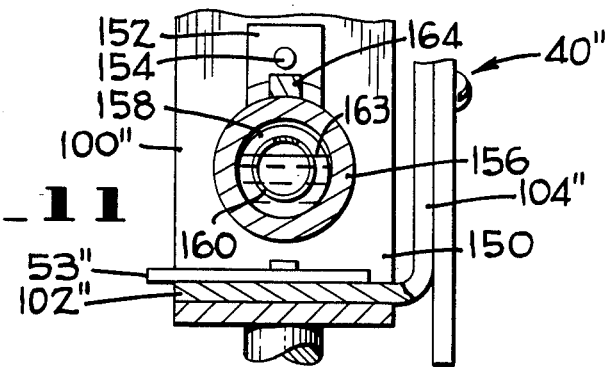
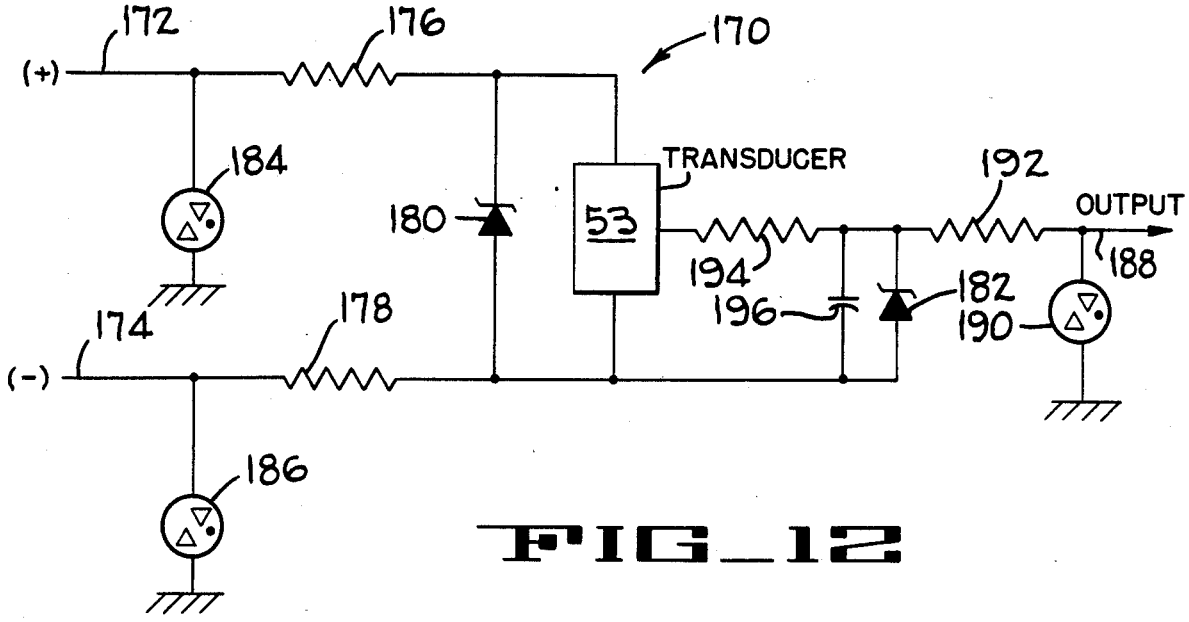
FIG_12

FIG_14
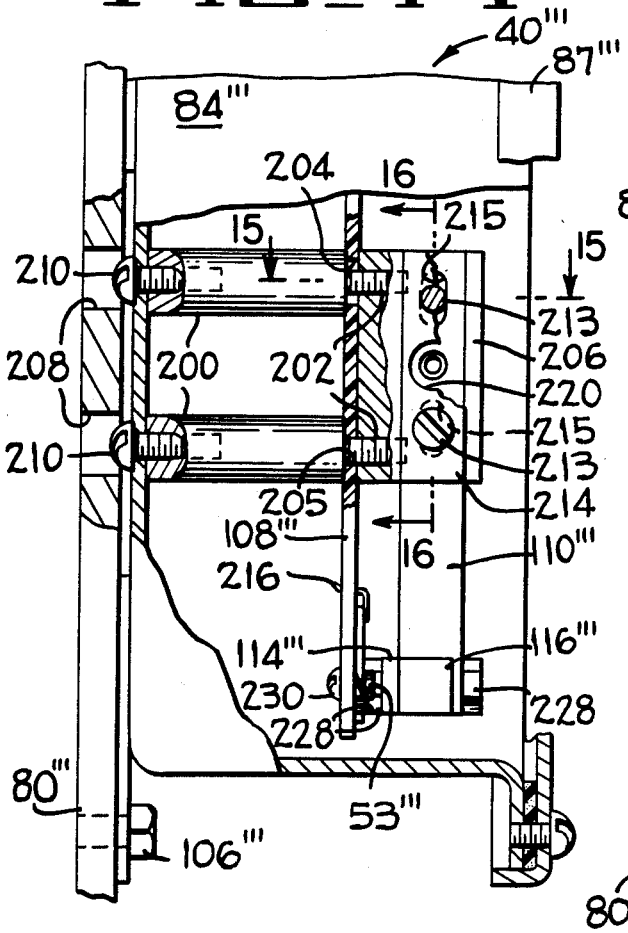
FIG_13
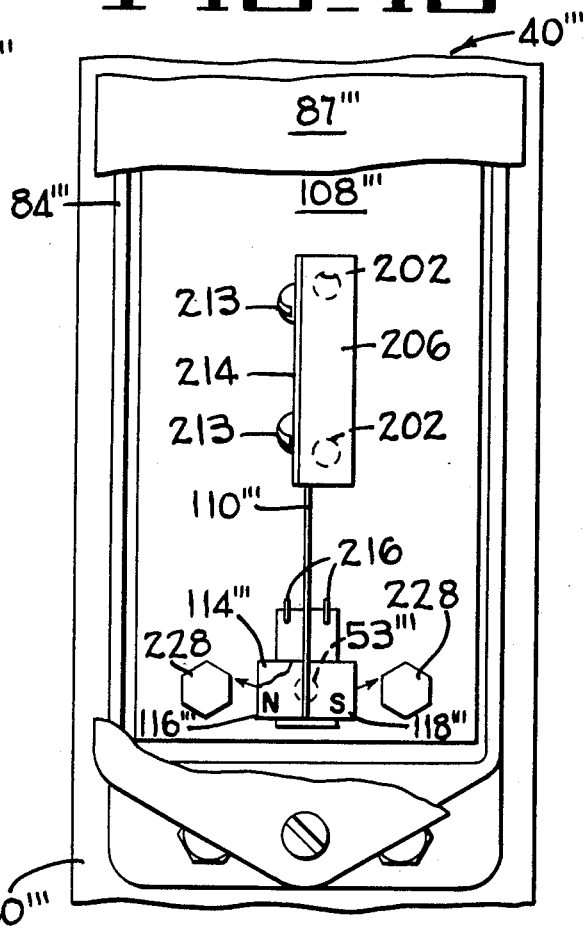
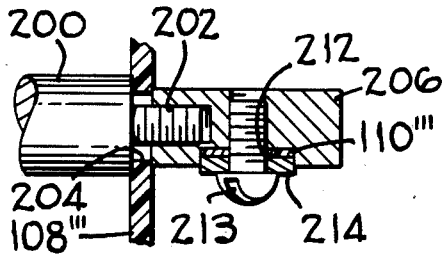
FIG_15
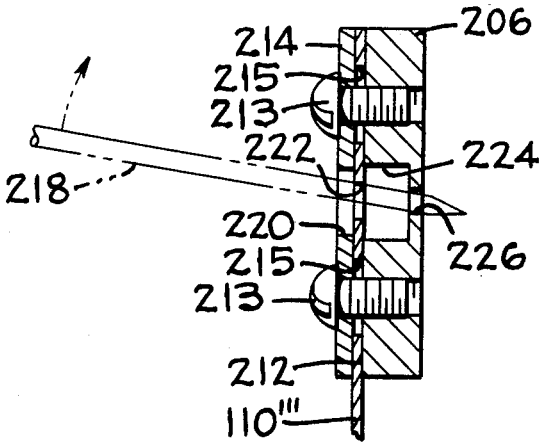
FIG_16

APPARATUS FOR DETECTING CHANGES IN INCLINATION OR ACCELERATION

CROSS REFERENCE TO RELATED APPLICATION

The apparatus of the present invention for detecting changes in inclination or acceleration is useable in the apparatus disclosed in assignee's McTamaney et al application Ser. No. 450,597 which was filed on Dec. 17, 1982 and issued on Dec. 11, 1984 as U.S. Pat. No. 4,487,061 entitled Method and Apparatus For Detecting Well Pump-Off. The disclosure of this prior art application is incorporated by reference herein.

BACKGROUND OF THE INVENTION

Field of the Invention

The present invention relates to an apparatus for detecting variations in inclination or acceleration of an article and to generate a signal representative of the position of the article, and more particularly relates to an apparatus associated with the walking beam of a sucker-rod type pump for providing a signal which assists detection of fluid pound in wells employing sucker-rod pumping units.

Although the invention will be described in relation to its preferred pump controlling environment, it will be understood that there is a need for the apparatus in other environments. The apparatus will be referred to herein as an inclinometer, which inclinometer is capable of producing an output signal related to changes in angular positions of an article and/or changes in acceleration of an article. The inclinometer of the present invention performs these functions with a high degree of repeatability and with substantially infinite life at an extremely low price and is sufficiently accurate to perform its intended function. Known inclinometers, such as a Humphrey pendulum, use a simple pendulum which rotates a potentiometer and is relatively expensive, is highly accurate and repeatable, but has a limited life. Known prior art accelerometers can also be used as inclinometers but have limited life due to wear at pivot points, bearings, and wear to the potentiometer. The comparative cost of the above known devices are approximately six to ten times that of the inclinometer of the present invention.

The preferred use of the apparatus of the present invention is for detecting pound in wells employing sucker-rod pumping units.

Sucker-rod type pumping units are widely used in the petroleum industry in order to recover fluid from wells extending into subterranean formations. Such units include a sucker-rod string which extends into the well and means at the surface for an up and down movement of the rod string in order to operate a downhole pump. Typical of such units are the so called "beam-type" pumping units having the sucker-rod string suspended at the surface of the well from a structure consisting of a Samson post and a walking beam pivotally mounted on the Samson post. The sucker-rod string normally is connected at one end of the walking beam and the other end of the walking beam is connected to a prime mover such as a motor through a suitable crank and pitman connection. In this arrangement the walking beam and the sucker-rod string are driven in a reciprocal mode by the prime mover.

A variety of malfunctions such as worn pumps, broken sucker-rods, split tubing, and stuck pump valves can interrupt the pumping of fluid from a well. Such malfunctions can be caused by normal wear and tear on the equipment, by the nature of the fluid being pumped or they could be caused by abnormal pumping conditions.

One abnormal pumping condition which is fairly common is known as "fluid pound". Fluid pound occurs when the well is pumped-off, i.e., when fluid is withdrawn from the well at a rate greater than the rate at which the fluid enters the well from the formation. When this occurs, the working cylinder of the downhole pump is only partially filled during an upstroke of the plunger and on the downstroke of the plunger strikes or "pounds" the fluid in the working cylinder causing severe jarring of the entire pumping unit. This causes damage to the rod string and to the surface equipment and may lead to failure of the pumping unit.

SUMMARY OF THE INVENTION

The inclinometer of the present invention eliminates the need for the pivot bearings required in simple pendulums by employing a cantilever spring secured to a bracket, thus eliminating the stick-slip friction which causes erratic readings. In the preferred embodiment, the cantilever spring is preferably made of a manganese alloy, such as C.D.C. alloy 780, which has high internal damping, i.e., friction loss. Also, if the stresses caused by deflection are kept below the material endurance limit, the spring will have an infinite life.

The potentiometer slides of the prior art devices such as that disclosed in the cross-referenced McTamaney et al application are also eliminated by replacing the potentiometers with a magnetic field sensor such as a Hall effect transducer which cooperates with a magnet secured to the lower end of the spring. The Hall effect transducer provides a linear output, i.e., the voltage is directly proportional to the position of the magnet. When the inclinometer is tipped, the position of the magnet and the magnetic field sensor will change in a predictable and highly repeatable manner. This will give a voltage proportional to the angle of tilt.

Although a Hall effect or linear output transducer is used in the preferred embodiment of the invention, it will be understood that other non-contacting magnetic measurement means, for example a magnetoresistive sensor, that provides an output which varies with changes in the magnetic field that it is exposed to may be used in place of the Hall effect transducer. As used in the specification and claims, the term "magnetic field sensors" is intended to cover Hall effect or other linear transducers as well as magnetoresistive sensors or their equivalents.

BRIEF DESCRIPTION OF THE DRAWINGS

FIG. 10 is a side elevation of a third embodiment of the inclinometer of the present invention with parts cut away.

FIG. 11 is a vertical section taken along lines 11—11 of FIG. 10.

FIG. 12 is a transient protection circuit for use with each of the embodiments of the invention for protecting the sensor or transducer and for providing a constant voltage to the transducer.

FIG. 13 is an enlarged side elevation of a fourth or preferred embodiment of the inclinometer of the present invention with certain parts cut away and other parts shown in section.

FIG. 14 is an end elevation of the inclinometer of FIG. 13, certain parts being cut away.

FIG. 15 is a section taken along lines 15—15 of FIG. 14 illustrating an oversize hole in the upper portion of the printed circuit board for centering the swing of a magnet relative to the sensor.

FIG. 16 is a section taken along lines 16—16 of FIG. 14 illustrating structure for adjusting the spring by moving it vertically relative to the printed circuit board thereby accurately calibrating the inclinometer.

DESCRIPTION OF THE PREFERRED EMBODIMENT

Figure 1:
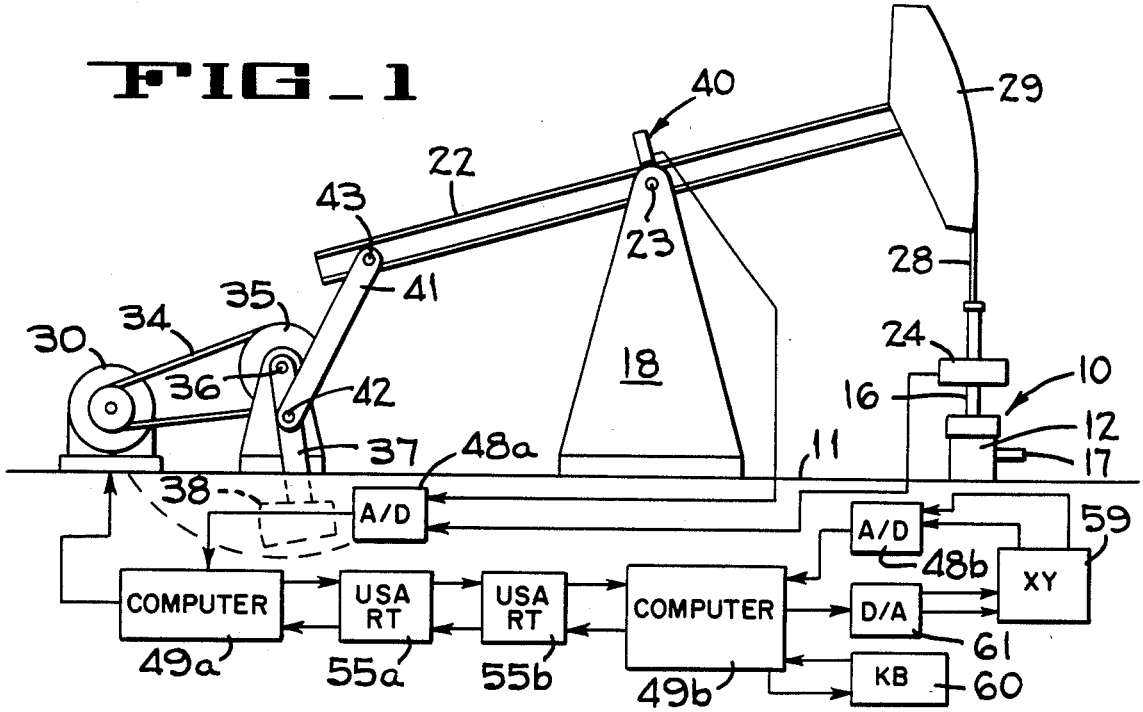
FIG. 1 is a diagrammatic illustration of a sucker-rod type pumping unit upon which the inclinometer of the present invention is mounted when used in its preferred environment.

Prior to describing the specific features of the apparatus of the present invention, the mechanical and electrical components of the sucker-rod pumping unit will be described to provide a better understanding of the invention when used in its preferred environment.

A wellhead 10 (FIG. 1) is supported by the earth surface 11 having a well (not shown) which extends downwardly into a subsurface well producing formation. The wellhead comprises the upper portions of a casing string 12 with a sucker-rod string 16 extending downward into a down hole pump (not shown) which moves liquid to the surface where it passes into a flow line 17. The sucker-rod string 16 is suspended in the well from a support unit consisting of a support post 18 and a walking beam 22 which is pivotally mounted on the support post by a pin connection 23. A load cell 24 is connected between the upper end of the sucker-rod string 16 and the lower end of a cable section 28. The cable section 28 is connected to the walking beam 22 by means of a horsehead 29.

The walking beam 22 is reciprocated by a prime mover such as an electric motor 30. The prime mover drives the walking beam through a drive system which includes a drive belt 34, crank 35, crank shaft 36, crank arm 37 and a pitman 41 which is pivotally connected between the crank arm and the walking beam by means of pin connections 42,43. The outer end of the crank arm 37 is provided with a counterweight 38 which balances a portion of the load on the sucker-rod string in order to provide a more constant load on the prime mover. The inclinometer 40 of the present invention is mounted on the walking beam 22 preferably above the pivot point 23 of the beam 22 or within about a foot of the pivot pin.

Figure 4:
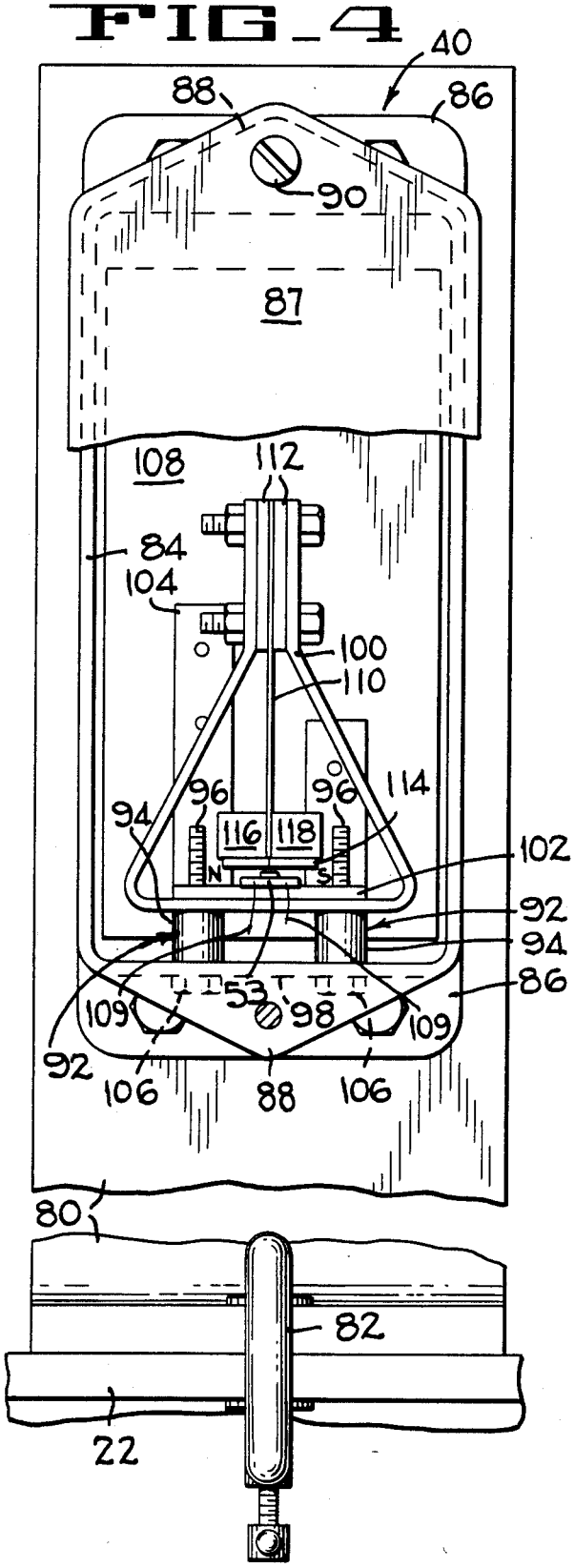
FIG. 4 is an enlarged elevation of a first embodiment of the inclinometer of the present invention shown with the cantilever spring in a vertical position, certain parts being broken away.

The load cell 24 provides a DC output signal which is proportional to the load on the sucker-rod string 16, and an analog-to-digital converter 48*a* provides a corresponding digital signal to a computer 49*a*. The inclinometer 40 and its associated magneticfield sensor 53 (FIG. 4) which may be a Hall effect transducer measures the angle of the walking beam 22 which in turn measures the vertical position of the sucker-rod string 16 by providing a voltage which is proportional to the angle of the walking beam 22 and thus is proportional to the position of the rod string 16. The digit-to-analog converter 48*a* also converts the signal from the sensor 53 into a digital signal which is used by the computer 49*a*. Signals are transferred from the computer 49*a* to a computer 49*b* by a pair of universal synchronous asynchronous receiver transmitters (USARTs) 55*a*,55*b* for controlling the operation of an XY plotter 59. Instructions from a keyboard and display unit 60 and output signals from the load cell 24 and inclinometer 40 are used by the XY plotter to provide a visual plot of the characteristics of the particular well which the rod string operates. The plotter 59 can be used for observing operation of the well and for setting up the equipment to monitor the well. After setup is completed the plotter can be disconnected, or if desired the plotter can be eliminated altogether and other means for setting up the equipment can be used. Analog signals from the XY plotter 59 are converted into digital signals by an analog-to-digital converter 48*b* for use by the computer 49*b*, and digital signals from the computer 49*b* are converted into analog signals by a digital-to-analog converter 61 for use by the plotter.

Figure 2:
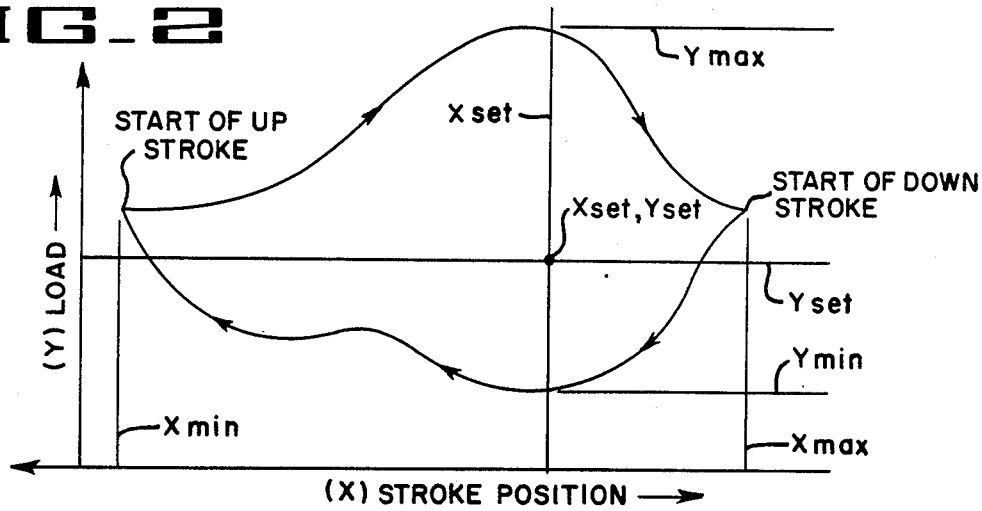
FIG. 2 is a plot of position versus load of the sucker-rod of the pump for one cycle of normal operation.

A plot of the position versus load of the rod string 16 for a typical cycle of the rod string when the well is filled with fluid is disclosed in FIG. 2. It can be seen that as the rod string moves on the upstroke from the Xmin position to the Xmax position, the load on the string increases to a maximum value and then returns to approximately the initial value. Of more importance is the variation in the load as the rod string moves downward with the load decreasing to a minimum value at a fairly rapid rate and then moving upward to approximately the original value at the Xmin position.

Figure 3:
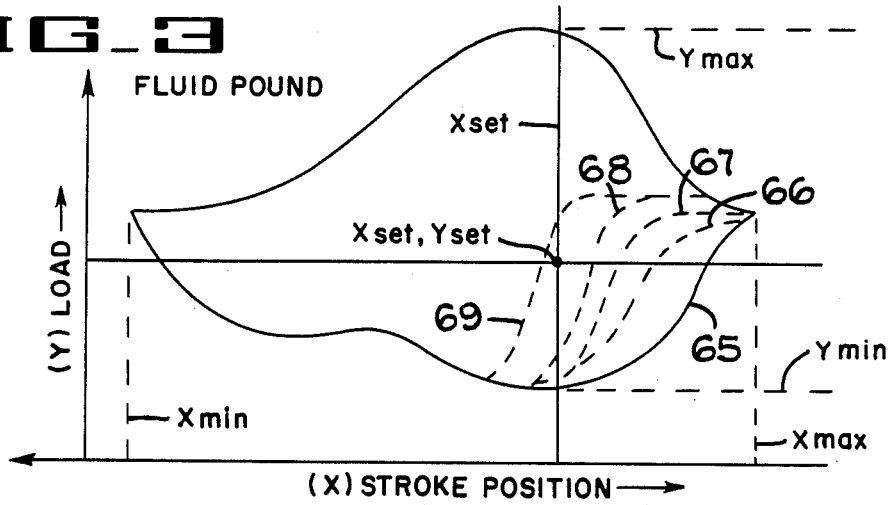
FIG. 3 is a plot of position versus load of the sucker-rod as the well progresses into fluid pound.

As the well approaches pump-off (FIG. 3), the load on the rod string changes more rapidly as the rod string moves in a downward direction. When the fluid in the well drops, a pump plunger in the pump falls and strikes the surface of the fluid in the well producing a "fluid pound" which can damage the rod string and other parts of the pumping system. As the fluid level in the well decreases the pump plunger progressively moves a greater distance on the downstroke before contacting the surface of the fluid in the well causing the plotted load curve to progressively change from the full well curve 65 to the dotted curves 66–69 with the curve moving progressively toward the left as the fluid in the well drops lower. This moving trend can be observed and the pump shut down to prevent damage to the equipment.

The XY plotter 59 will also provide a visual gas pound plot (not shown) as the rod string approaches pump-off and the area above the liquid level in the pump is filled with gas under pressure. The gas pound curve is similar to the fluid pound curve of FIG. 3 except that the progressively changing pump-off curves are closer to linear as compared to the curves 66–69 of FIG. 3. Reference may be had to the aforementioned McTamaney et al application if a more detailed description of the gas pound plot is desired.

From the above brief description of a sucker-rod pump system it is apparent that variations in the load acting on the sucker-rod string 16, and variations in the vertical position of the sucker-rod string provide output signals which are transmitted to computers for detecting pump-off in a well.

The first embodiment of the inclinometer 40 of the present invention provides the output signals for determining the vertical position of the sucker-rod string, while the load cell 24 provides the output signal for determining the load variations acting on the sucker-rod string 16. These signals are processed by methods and apparatus such as that disclosed in the cross-referenced McTamaney et al U.S. Pat. No. 4,487,061 and forms no part of the present invention. Accordingly, the following description of the inclinometer of the present invention will be limited to the components which produce output signals, but will not describe how the output signals are processed.

Figure 5:
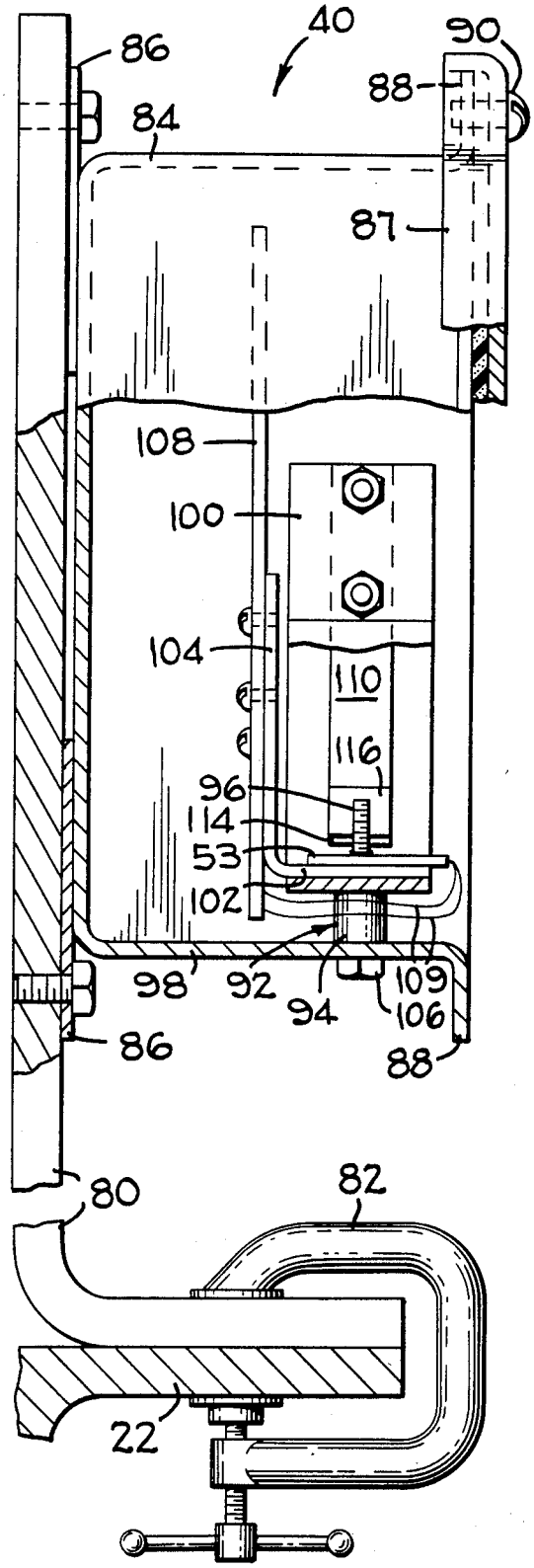
FIG. 5 is an end elevation of the inclinometer of FIG. 4, certain parts being cut away.

The first embodiment of the inclinometer 40 (FIGS. 4–6) of the present invention is mounted on the walking beam 22, preferably above or adjacent to the pivot pin 23 (FIG. 1) by an L-shaped bracket 80 (FIGS. 4–6) and connectors such as clamps 82 since bolt holes drilled in the beam 22 may cause fatigue failure. A generally rectangular box 84 is welded to ears 86 which are bolted to the bracket 80. The box 84 is closed by a foam filled cover 87 which is connected to V-shaped flanges 88 of the box 84 by connectors 90 (only one being shown) thereby isolating the working components of the inclinometer within the box during operation of the inclinometer.

An advantage of placing all sensitive components of the inclinometer 40 in a box 84 and clamping, rather than bolting the box to a walking beam 22 is that no adjustment will be required to the inclinometer in the event the position of the inclinometer on the beam needs to be changed or the inclinometer is removed from one beam and is transferred to another beam because the first well has become non-productive. All that is necessary is that the polarity of the magnet remains the same for each installation. This is accomplished by clamping the box to the associated beam with the same side of the box, for example the cord side, facing the sucker-rod thus providing substantially the same plot for each well as that illustrated in FIGS. 2 and 3. If the components in the box were to be reoriented to provide a consistent polarity, the sensitive components would have to be recalibrated.

A pair of non-magnetic spacer blocks 92 each having an internally threaded large diameter portion 94 and an externally threaded small diameter portion 96 are provided to mount the working components to the lower wall 98 of the box 84. The small diameter portion 96 of each spacer block extends through a hole in the bottom wall of a generally triangular spring frame 100 and is tightly screwed into a threaded opening in the lower wall 102 of an L-shaped printed circuit board bracket 104 with the upper end extending a substantial distance above the lower wall 102. A pair of screws 106 extend through associated holes in the lower wall 98 of the box 84 and are screwed into the large portion 94 of the associated spacer block 92 thereby rigidly securing the L-shaped bracket 104 and the triangular spring frame 100 to the box 84. A circuit board 108 is rigidly connected to the bracket 104, and the upper end of a leaf spring 110 is inserted between spacers 112 and bolted to the upper end of the triangular spring frame 100. The lower end of the leaf spring 110 is rigidly secured to a magnet 114 and to weights 116, 118 which act as pole concentrators. The leaf or cantilever spring 110 is preferably formed from an annealed manganese alloy such as C.D.C. alloy 780 having high damping properties. It will be noted that the weights 116, 118 will contact the small diameter portions 96 of the spacer blocks to prevent excessive deflection and damage to the spring 110 in the event the inclinometer 40 is subjected to severe vibrations or the like.

The magnet 114 has a north pole N and a south pole S and is disposed adjacent to and swings over the magnetic-field sensor 53 such as a Hall effect transducer or equivalent. The magnetic-field sensor 53 is supported on the base 102 of the L-shaped bracket 104 and is wired to the printed circuit board 108, preferably by flying leads 109.

Figure 6:
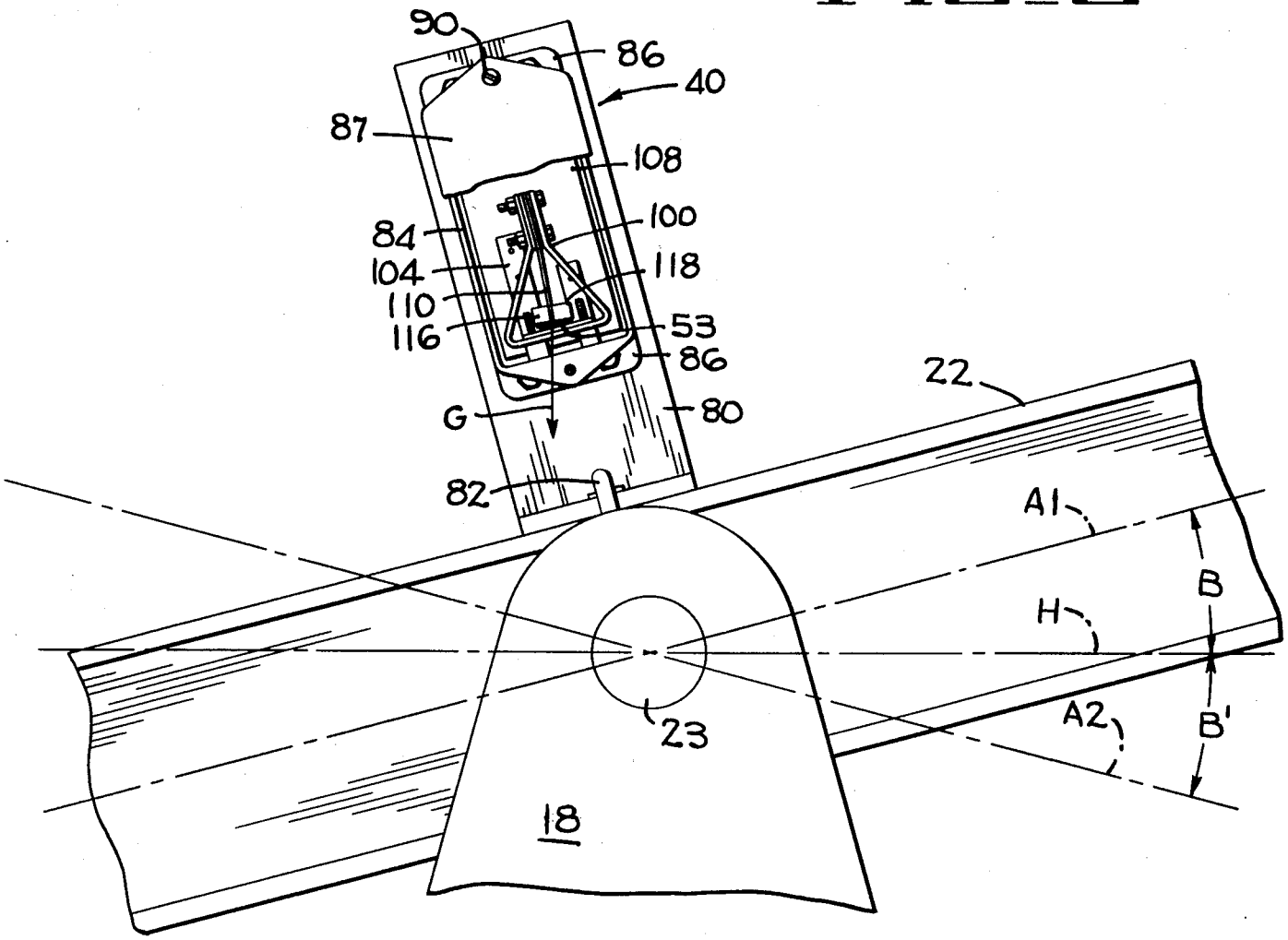
FIG. 6 is an operational view illustrating the inclinometer positioned at an angle relative to a horizontal plane with the force of gravity acting thereon.

As best illustrated in FIG. 6, it will be apparent that the gravitational force G acting on the weights 116, 118 is always directed downwardly normal to the horizontal and deflects the cantilever spring 110 toward the lower end of the walking beam 22, i.e., toward the left when the beam 22 is in its full line position indicated in FIG. 6. At this time, the north and south poles of the magnet 114 will not be centered on the magnetic-field sensor 53 but will be shifted to the left (FIG. 6). When the beam 22 is pivoted so that its longitudinal axis moves from position A1 to its horizontal position H, or when it moves from position A2 to its horizontal position, the force which tends to return the cantilever spring 110 to its vertical position is furnished by both the pull of gravity and forces applied by the cantilever spring. This combined spring and gravitational force, as compared to forces acting on a simple pendulum which use only gravity as a restoring force, affects an increase in the system's first order of natural frequency of vibration many times over that of a simple pendulum. The increase of the system's first order of natural frequency is important because it allows operation at higher oscillating speeds without being troubled by excessive displacement amplification and phase shift.

As the walking beam is pivoted between longitudinal axes A1 and A2, the center of the magnet 114 will swing from the left to the right of the center of the magnetic-field sensor, and will change in a predictable and highly repeatable manner with the error being less than 1%. This will give a voltage that is proportional to the angles B and B′ which are the angles of inclination of the axis of the walking beam 22 relative to the horizontal as the walking beam is pivoted about pivot pin 23. In the preferred embodiment, the maximum operating frequency is less than 6 HZ. The inclinometer natural frequency is greater than 30 HZ.

As mentioned above, the inclinometer 40 is preferably mounted adjacent the pivot axis of the walking beam 22 since the inclinometer will be affected by angular position and centrifugal force due to centrifugal acceleration of the walking beam 22. The error induced by centrifugal force is proportional to the distance and position of the inclinometer from the pivot axis 23 of the walking beam 22 and the angular velocity of the beam, thereby distorting the position output signal. However, when the walking beam is cycled in the same way each time, the readings will be repeatable and the errors correctable.

Figure 7:
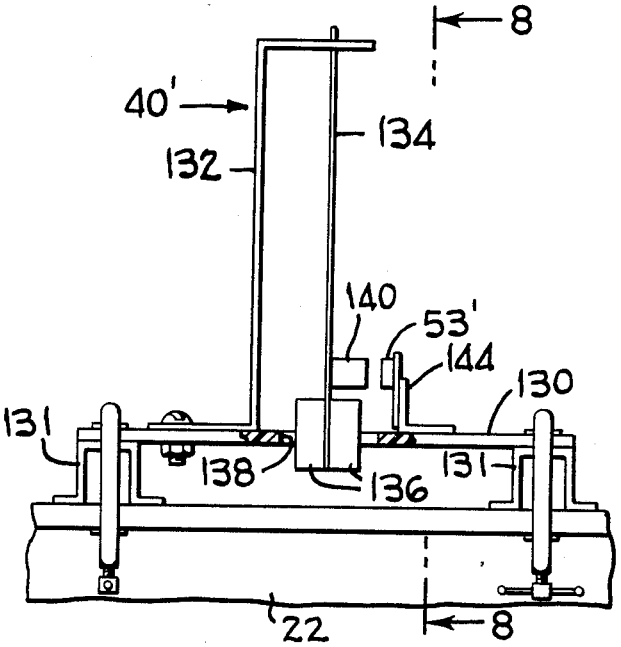
FIG. 7 is a side elevation of a second embodiment of the inclinometer of the present invention.
Figure 8:
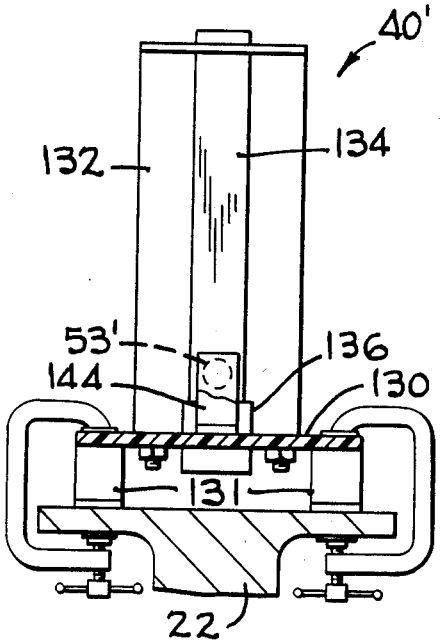
FIG. 8 is an end elevation of the inclinometer of FIG. 7 looking in the direction of arrows 8—8 of FIG. 7.

The inclinometer 40' (FIGS. 7–9) of the second embodiment of the present invention comprises a printed circuit board or PC board 130 and brackets 131 that connect the PC board 130 to the walking beam 22 of the wellhead 10 (FIG. 1) preferably over the pivot point 23 (FIG. 1). A bracket 132 (FIGS. 7–9) is bolted to the PC board and has the upper end of a cantilever spring 134 rigidly secured thereto. A weight or mass 136 is secured to the lower end of the spring 134 and extends into a hole 138 formed in the PC board which limits the permissible deflection of the spring 134 thereby preventing damage to the spring by over deflection.

A magnet 140 is secured to the cantilever spring 134 at a point adjacent to the linear output transducer 53' which is a magnetic-field sensor or equal. The transducer 53' is supported on the PC board 130 by a bracket 144 and is wired to the printed circuit board 130.

Figure 9:
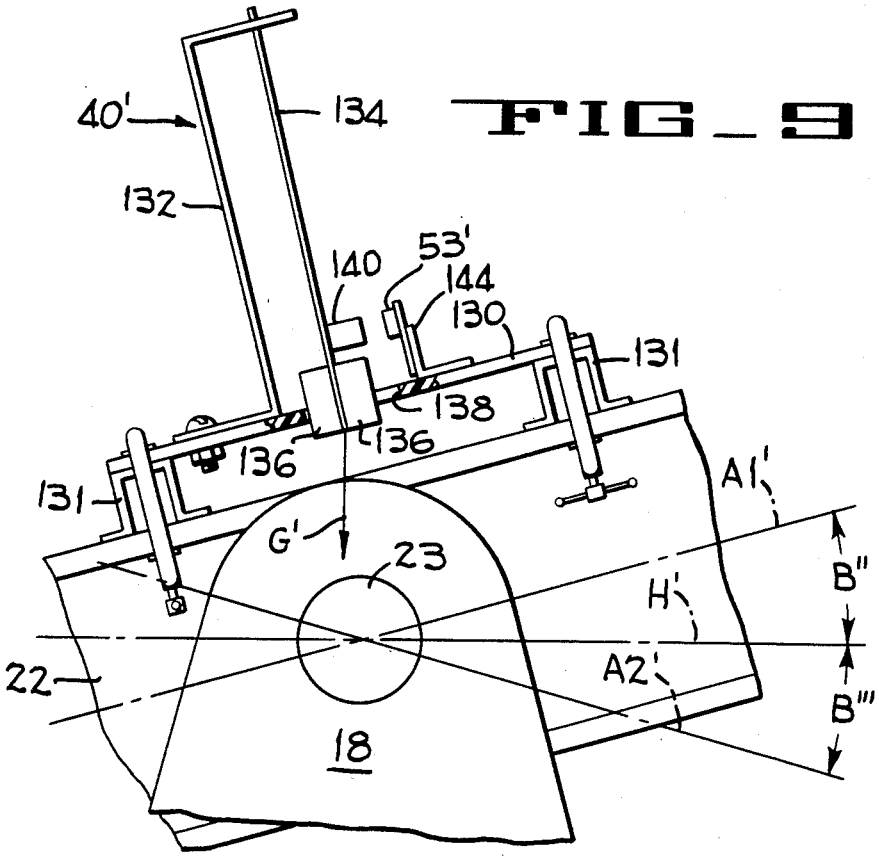
FIG. 9 is a diagrammatic operational view illustrating the inclinometer of the second embodiment at an exaggerated scale and positioned at an angle relative to a horizontal plane with the forces of gravity acting thereon.

As best illustrated in FIG. 9, it will be apparent that the gravitational force G' acting on the weight 136 is always directed downwardly normal to the horizontal and deflects the cantilever spring 134 toward the lower end of a walking beam 22, i.e., toward the left when the beam 22 is in its full line position as indicated in FIG. 9. At this time, the distance between the magnet and the magnetic-field sensor will increase. When the beam 22 is pivoted so that its longitudinal axis moves from position A1' to its horizontal position H', or from position A2' to its horizontal position, the force which tends to return the cantilever spring 134 to its vertical position is furnished by both the pull of gravity and the forces applied by the cantilever spring. This combined spring and gravitational force as compared to the forces acting on a simple pendulum which uses only gravity as a restoring force, affects an increase in the system's first order natural frequency of vibration many times over that of a simple pendulum. The increase of the systems first order of natural frequency is important because it allows operation at higher oscillating speeds without being troubled by excessive displacement amplification and phase shift.

As the walking beam is pivoted between longitudinal axes A1' and A2', the distance between the magnet 140 and the magnetic-field sensor will change in a predictable and highly repeatable manner with the error being less than 1%. This will give a voltage that is proportional to the angle B'' and B''' which are the angles of inclination of the axis of the walking beam 22 relative to the horizontal as the walking beam is pivoted about pivot pin 23.

As in the first embodiment, the inclinometer is preferably mounted adjacent the pivot axis of the walking beam 22 since the inclinometer will be affected by angular position changes and centrifugal force due to oscillation of the walking beam 22, and it is desirable to minimize the forces due to centrifugal force.

A third embodiment of the inclinometer 40'' (FIGS. 10 and 11) includes certain parts that are similar to those of the first embodiment, and accordingly the parts of the third embodiments that are similar to the first embodiment will be assigned the same numerals followed by a double prime (").

The inclinometer 40'' comprises a magneticfield sensor 53'' which is rigidly secured to the base 102'' of the printed circuit board frame 104'' and is disposed within the box 84'' when in operation. A modified form of the bracket 100'' includes upstanding ears 150 which are attached to angle clips 152 by screws 154. The angle clips are secured to a non-magnetic tube 156 which has a magnet 158 and at least one return spring 160 therein. The ends of the tube 156 are closed by end caps 162 and the tube is partially filled with a damping liquid such as silicon 163. If a single return spring 160 is used, the end of the spring is connected to one end of the magnet and to the adjacent end cap 162. If two return springs are used as illustrated in FIG. 10, the springs 160 merely abut the magnet and the associated end caps.

A magnetic article 164 such as a steel wire or a bar magnet is mounted on the upper surface of the tube 156 and provides a force which tends to lift the magnet 158 thus minimizing friction between the magnet 158 and the tube 156 during operation of the inclinometer 40''.

During operation of the inclinometer 40'' when used in its preferred environment, inclination of the frame 104'' causes the magnet 158 to move relative to the sensor 53'' toward the low side of walking beam 22 (FIG. 1) and the return spring 160 (or springs) returns the magnet 158 to its illustrated central position when the beam 22 is horizontal. During oscillation of the beam 22, the damping fluid flows through the gaps between the magnet 158 and the tube 156 thus damping the motion of the magnet 158.

A magnetic-field sensor circuit 170 (FIG. 12) is provided in order to provide a maximum voltage to the magnetic-field sensor to provide transient protection to the sensor of the inclinometer of each embodiment of the invention from damage or destruction by lightning or the like. During normal operation, the circuit 170 receives power from a direct current source from lines 172 and 174 and directs the current through resistors 176, 178 in lines 172, 174 and through zener diode 180 which limit the maximum input voltage to the transducer, for example 15 volts.

In the event lightning is induced in line 172 causing a high voltage pulse, a spark gap protector 184 begins to conduct thereby causing the excess voltage in line 172 to be discharged to ground. The resistor 176 limits the flow of current to the zener diode 180, and the zener diode 180 then clamps or limits the maximum voltage to the transducer 53. Similarly, if lightning induces high voltage in line 174, a spark gap protector 186 ionizes the gas therein and closes causing the excess voltage to be grounded. The resistor 178 prevents excess current from damaging the sensor 53. Likewise, if lightning is induced into the output line 188, spark gap protector 190 begins to conduct discharging excess voltage to ground, a resistor 192 in line 188 prevents excessive current from damaging the zener diode 182, and then the zener diode 182 prevents the voltage in line 188 from exceeding the desired voltage, for example 15 volts. A resistor 194 and a capacitor 196 forms a low pass filter that eliminates induced mechanical resonance.

The first three embodiments of the invention will provide accurate signals when used in environments which do not vary substantially in temperature. For example, these embodiments will operate quite satisfactorily when the temperature of the environment varies within about 50° F.

The fourth or preferred embodiment of the inclinometer 40''' of the present invention is specifically designed to reliably and accurately operate in environments which change substantially in temperature, for example, within a range of about 175° F. without requiring recalibration. As mentioned previously, the preferred use of the inclinometer is in conjunction with a sucker-rod pump, and such pumps may be used in cold climates where the temperature drops to about −45° F., or may be used in hot deserts where the temperature raises to about 130° F. Thus, the inclinometers 40''' may be manufactured and calibrated at the factory and be shipped to areas of use which vary in temperature between about −45° F. to 130° F. without requiring recalibration.

The fourth embodiment of the inclinometer 40''' (FIGS. 13–16) of the present invention is in many respects similar to the first embodiment. Accordingly, only the differences will be described in detail and parts of the fourth embodiment that are equivalent to those of the first embodiment will be assigned the same numerals followed by a triple prime (''').

The inclinometer 40''' is clamped to the walking beam 22 (FIG. 1) by a clamp and an L-shaped bracket 80''' as in the first embodiment of the invention. A box 84''' and its cover 87''' (only a fragment being shown) are connected to the bracket 80''' by capscrews 106''' (only one being shown).

As shown in FIG. 14, cylindrical spacers 200 have small diameter externally threaded portions 202 which extend through holes 204 and 205 in the printed circuit board 108''' and are screwed into threaded holes in a spring supported block 206. It will be noted that the upper hole 204 of the printed circuit board is of a relatively large diameter permitting the block 206 and the cantilever spring 110''' attached thereto to be angularly adjusted relative to the plane of the printed circuit board 108''' for accurately adjusting the swing of the spring 110''' relative to the printed circuit board 108''' before tightening the spacers 200. Access holes 208 in the bracket 80''' permit screws 210 to be inserted therethrough and through holes in the box 84''' and to be screwed into the spacers 200 to securely attach the spacers to the box. As in the first and second embodiments of the invention, the leaf or cantilever spring 110''' is preferably formed from an annealed manganese alloy such as C.D.C. alloy 780 which has high damping properties.

As best shown in FIG. 15 and 16, the spring 110''' fits within a vertical slot 212 in the block 206 permitting the spring to be vertically adjusted in the slot. Capscrews 213 extend through holes in a narrow cover plate 214, through slots 215 in the spring and are screwed into threaded holes in the block 206 thereby rigidly securing the spring 110''' in adjusted position.

A sensor, 53''', preferably a Hall effect transducer, is secured to the printed circuit board 108''' as by gluing, and is electrically connected to the circuit board by soldering leads 216 to the printed circuit board. A magnet 114''' and weights 116''' and 118''' are rigidly secured to the lower end of the spring 110''' as in the first embodiment of the invention. As shown in FIG. 16, the spring 110''' may be adjusted longitudinally of its length with the aid of a lever or pick 218 which extends through a large hole 220 in the plate 214, a small hole 222 in the spring 110''' and through a large diameter hole 224 and a small diameter hole 226 in the spring supporting block 206. Prior to mounting the operative components of the inclinometer in the box 84''', the operator slightly loosens the screws 213 and then inserts the pick 218 through the holes 220, 222, 224 and 226 and pries the spring up or down relative to the block 206 until it is precisely and properly adjusted. The screws are then firmly tightened to lock the spring 110''' in its desired calibrated position.

As in the first and second embodiments of the invention, stop means illustrated as hexagonal blocks 228 (FIGS. 13 and 14) are secured to the printed circuit board 108''' by screws 230 and serve to prevent excessive deflection and damage to the spring 110'''.

The fourth embodiment of the inclinometer 40''' has the advantage of being accurately calibrated when initially assembled for operation in areas which may vary in temperature from between about −45° F. to 130° F. without requiring readjustment when used in cold places in the winter or hot places such as a desert area in the summer.

From the foregoing description it is apparent that the apparatus of the present invention is a simple, inexpensive and long life device which is capable of measuring changes in inclination or acceleration of a movable mechanism upon which it is mounted. In its preferred environment, the apparatus is an inclinometer that is mounted on the walking beam of a sucker-rod pump and provides signals which detect pump-off. More specifically, the apparatus provides the output signals for determining the vertical position of the sucker-rod string of the pump without relying on rotatable means or rheostats, both of which are subject to wear or breakage and inaccuracy during extended use. Moreover, these parts may be damaged due to snow, high winds, or the like. Although the apparatus of the present invention has been disclosed as an inclinometer used in a sucker-rod pumping system, it will be understood that the apparatus may be used in other environments for detecting changes in acceleration or inclination and providing output signals, which signals are processed by means not disclosed in the present application.

Although the best mode contemplated for carrying out the present invention has been herein shown and described, it will be apparent that modification and variation may be made without departing from what is regarded to be the subject matter of the invention.

What is claimed is:

1. In an apparatus for monitoring the operation of a well pumping unit which includes a walking beam having a sucker-rod string attached thereto and a power unit for oscillating said beam about a horizontal axis to reciprocate said rod string for producing fluid from an underground location, the improvement which comprises apparatus for detecting the position of the rod string during reciprocation of said rod string, said position detecting means comprising:

support means operatively connected to said walking beam for oscillatory movement;

means defining a magnetic-field sensor rigidly secured to said support means;

cantilever spring means having one end portion rigidly secured to said support means at a point removed from said sensor means;

magnet means secured to said cantilever spring means at a position removed from said one end and disposed closely adjacent to said sensor means, said magnetic means moving arcuately relative to said sensor means in response to oscillation of said walking beam between a centered position wherein said walking beam is at about the mid-point of its oscillatory movement and said cantilever spring means is disposed in a vertical plane over the center of said sensor means, and wherein pivotal movement of said walking beam in both directions from said magnet means from one side to the other side spring means due to gravitational forces acting on said magnet means form one side to the other side of said plane for providing a linear voltage output signal that is proportional to said relative movement and is useable for determining the position of said rod string;

weight means secured to said spring means at a location adjacent said magnetic means;

stop means rigidly secured to said support means on both sides of the path of movement of said weight means for preventing excessive deflection of and damage to said spring means; and a printed circuit board rigidly secured to said support means and structurally supporting said magnetic-field sensor means, said cantilever spring means performing its functions with a high degree of repeatablility and with substantially infinite life at an extremely low price.

* * * * *